United States Patent [19]

Murtaugh

[11] 3,965,048

[45] June 22, 1976

[54] SOAP CURD DISSOLVING DRAIN CLEANER

[75] Inventor: Justin J. Murtaugh, Guilford, Ind.

[73] Assignee: The Drackett Company, Cincinnati, Ohio

[22] Filed: Mar. 29, 1974

[21] Appl. No.: 456,429

[52] U.S. Cl. ..... 252/527; 134/40; 252/89 R; 252/156; 252/173; 252/546; 252/DIG. 14; 252/DIG. 17

[51] Int. Cl.[2] ..... B08B 9/06; C11D 7/06; C11D 7/32; C23G 5/00

[58] Field of Search ..... 252/117, 527, 546, 156; 134/38, 40

[56] References Cited

UNITED STATES PATENTS

| | | | |
|---|---|---|---|
| 2,240,957 | 5/1941 | Munz | 252/546 |
| 2,997,444 | 8/1961 | Martin | 252/156 |
| 3,454,500 | 7/1969 | Lancashire | 252/110 |
| 3,673,098 | 6/1972 | Sabatelli | 252/156 |
| 3,697,431 | 10/1972 | Summerfelt | 252/103 |
| 3,870,560 | 3/1975 | Shumaker | 252/156 X |

*Primary Examiner*—Dennis L. Albrecht
*Attorney, Agent, or Firm*—David J. Mugford; George A. Mentis; Samuel J. DuBoff

[57] ABSTRACT

Drain cleaning compositions, especially effective in dissolving soap curd, are provided which comprise in aqueous solution a potassium salt of nitrilotriacetic acid, N-2-hydroxyethylimino diacetic acid, an alkylene polyamine polycarboxylic acid, or mixtures thereof, and potassium hydroxide, wherein the compositions are substantially free of other alkali metal ions and the alkylene polyamine polycarboxylic acid has the formula $$(HOOCCH_2)_2N[(CH_2)_xNCH_2COOH]_yCH_2COOH$$

where $x$ and $y$ may each independently be from 1 to 4.

10 Claims, No Drawings

SOAP CURD DISSOLVING DRAIN CLEANER

This invention relates to drain cleaning compositions. More specifically, the invention relates to drain cleaning compositions which are more effective in dissolving soap curd, which causes clogging of a drain, than conventional drain cleaning compositions comprising a large quantity of concentrated acid, caustic, or oxidizing agent.

Drains for household sinks often become clogged by a combination of fatty substances, protein or cellulose fibers, and soap. Soap, although an excellent detergent, has the disadvantage that it reacts with the metallic ions in water to form an insoluble curd. This curd, formed from the calcium and magnesium ions of hard water and soap, together with small amounts of oil, grease, fatty substances from the body, cooking oils, or even hair grooming products, adheres to the inside of the drain and forms a restriction to the free flow of water. In addition, some solid, water-insoluble objects, such as hair, lint, or paper, become lodged in the drain at the point of restriction, so that eventually a clog is formed.

Most conventional drain cleaners composed primarily of concentrated solutions of a strong acid, base, or combination of a strong oxidizing agent and strong base, attack the clogging material lodged in the drain at the restriction. These conventional drain cleaners are effective in removing the clog but do not eliminate the initial problem, i.e. the deposit of soap curd in the drain causing the restriction, which may eventually cause a new clog to be formed.

The drain cleaning compositions of the present invention are advantageous because they dissolve soap curd deposits in the drain, so that no restriction of water flow occurs to allow clogging.

In order to remove soap curd deposits, sequestering agents are utilized, which are well known in the prior art. U.S. Pat. No. 2,921,908 discloses a composition comprising an alkaline salt of an amino polycarboxylate, as a sequestering agent, and an organic phosphate, which prevents corrosion of the drain pipes by the sequestering agent. U.S. Pat. No. 3,438,811 discloses scale removal compositions comprising an ammonia, amine, or hydroxy-alkylamine salt of a polycarboxylic acid, and an ammonia, an amine, or an alkali metal hydroxide, utilized to adjust the pH of the composition. U.S. Pat. No. 3,168,478 discloses highly alkaline surface active compositions comprising a phosphate ester, an alkali metal hydroxide, and a sequesterant. U.S. Pat. No. 3,001,945 discloses a liquid detergent composition comprising an amine oxide, an alkali metal salt of an amino polycarboxylate, and an alkali metal hydroxide, to adjust the pH of the composition.

In accordance with the present invention, an effective drain cleaning composition is provided by an aqueous solution of a potassium salt of nitrilotriacetic acid, N-2-hydroxyethylimino diacetic acid, an alkylene polyamine polycarboxylic acid, or mixtures thereof and potassium hydroxide, wherein the composition is substantially free of other alkali metal ions and the alkylene polyamine polycarboxylic acid has the formula $$(HOOCCH_2)_2N[(CH_2)_xNCH_2COOH]_yCH_2COOH$$

wherein $x$ and $y$ may each independently be from 1 to 7.

None of the prior art patents discussed above teaches the drain cleaning compositions of the present invention comprising a potassium salt of the sequestering agent and potassium hydroxide; where the compositions are substantially free of other alkali metal ions and where the amount of caustic necessary to effectively clean the drain can be less than that of conventional drain cleaners because of the unique coaction between these ingredients, as described below.

Although the present invention should not be limited to any particular theory, it is believed that the drain cleaning compositions of this invention react with soap curd to form a metal complex between the sequestering agent and the calcium or magnesium portion of soap curd. Because this metal complex is soluble in water, the soap curd may then dissolve and be washed down the drain, carrying along with it any other clogging material. However, along with formation of this metal complex, is the formation of the potassium salt of the fatty acid portion of soap curd. It is believed that the potassium salt forms a lyophilic colloidal system which is soluble in low concentrations. In solutions which are not extremely dilute, however, the salt is colloidal and forms an insoluble lyophilic potassium soap gel. This gel forms on the surface of the dissolving soap curd and retards or prevents dissolution of the soap curd and unclogging of the drain. Thus, although the insoluble soap curd can be dissolved by use of the potassium salt of the sequestering agent, it is prevented from being dissolved because of the formation of this surrounding insoluble gel.

Incorporation in the drain cleaning compositions of the present invention of potassium hydroxide eliminates the formation of this insoluble lyophilic potassium soap gel. It is believed that the potassium hydroxide acts as a coupling agent and causes the potassium salt of the fatty acid portion of the soap curd to be more soluble in water and not form this insoluble gel on the surface of the dissolving soap curd.

Thus, the small amount of potassium hydroxide in the compositions of this invention provide very mild alkalinity and although not as effective in saponifying fat or hydrolyzing other materials in a clog, as do higher caustic drain cleaners, the small excess of hydroxyl ions prevents formation of this lyophilic gel, which would prevent the dissolving of the solid soap curd. Most unexpected is the loss of this coupling effect when other alkali metal ions are present. This is especially true with sodium ions; when as little as 5% of the total ionic concentration in the composition is sodium ions.

In a preferred embodiment of this invention, a drain cleaning composition is provided which comprises from about 0.25% to about 5.0%, by weight, of a potassium salt of a member selected from the group consisting of ethylenediaminetetraacetic acid, nitrilotriacetic acid, or N-2-hydroxyethylimino-diacetic acid, or mixtures thereof; from about 0.50% to about 5.0%, by weight, of potassium hydroxide; and up to about 99%, by weight, of water, wherein the composition is substantially free of other alkali metal ions.

In a more preferred embodiment of the present invention, a drain cleaning composition is provided which comprises in aqueous solution from about 1.0% to about 3.0%, by weight, of a potassium salt of a member selected from the group consisting of ethylenediaminetetraacetic acid, nitrilotriacetic acid, or N-2-hydroxyethylimino-diacetic acid, or mixtures thereof; from about 1.0% to about 3.0%, by weight, of potassium hydroxide; from about .25% to about 3.0%, by weight, of a corrosion inhibitor selected from the group consisting of potassium silicate and potassium thioglycolate or mixtures thereof; and from about .25% to about 5.0%, by weight, of one or more anionic surfactants, wherein the composition is substantially free of other alkali metal ions.

Numerous sequestering agents, those agents which have the capability of chelating or complexing metal ions, are known in the prior art which are useful in the compositions of the present invention; for example, potassium gluconate, potassium heptanate, the salt of hydro-acetic acid and the soluble salts of alkylene polyamine polycarboxylic acids. The alkylene polyamine polycarboxylic acids are preferred because of their strong complexing action with calcium and magnesium ions in hard water and those particular salts which are more preferred, have the formula $$(HOOCCH_2)_2N[(CH_2)_xNCH_2COOH]_yCH_2COOH$$

wherein $x$ and $y$ may each independently be from 1 to 7. The salts most preferred are the salts having the above formula where $x$ and $y$ may each independently be from 1 to 4; nitrilotriacetic acid; and N-2-hydroxyethylimino-diacetic acid.

Representative of some of these salts of amino polycarboxylates especially useful in the compositions of this invention are ethylenediaminetetraacetic acid, N-2-hydroxyethyl-ethylene diamine triacetic acid, N-2-hydroxyethyl-nitrilodiacetic acid, ethylene diaminetetraproprionic acid, and diethylenetriamine pentaacetic acid. The above-described sequestering agents can be utilized in the compositions of this invention in all combinations, such as, for example, mixing of nitrilotriacetic acid and an alkylene polyamine polycarboxylic acid.

The minimum quantity of both a sequestering agent and potassium hydroxide present in the drain cleaning compositions of this invention have been found to be about, respectively, 0.25% and 0.50%. If much less than these amounts are utilized in the compositions, then the insoluble lyophilic gel forms and prevents dissolution of the soap curd. If only slightly lesser amounts are utilized, then the time necessary for dissolution of the soap curd is increased and the amount of soap curd dissolved is decreased. Generally, it has been found that about 5% of the sequestering agent and the potassium hydroxide is sufficient to provide an effective drain cleaning composition. Greater amounts of each of these ingredients can be utilized in these drain cleaning compositions, however, the use of such greater amounts is less economical without significantly increasing the efficiency in drain cleaning of these compositions.

A wetting agent or surfactant is preferably, but not necessarily, incorporated in the compositions of this invention. The wetting agent increases the rate at which the composition penetrates soap curd expecially when fatty substances are also present. About .25%, by weight, of a wetting agent is effective but up to 5.0%, by weight, may be utilized. Greater amounts are not significantly more efficient and are less economical. Many surfactants can be utilized in the drain cleaning compositions of this invention, as long as they are compatible with the sequesterant and potassium hydroxide and add no substantial quantity of other alkali metal ions to the compositions. It has been found that anionic surfactants are preferred. These may include a potassium salt of lauryl sulfate, an ammonium salt of a sulfated linear primary alcohol ethoxylate, a phosphate ester, such as one having the formula $$[R{-}O\,(CH_2CH_2O)_x]_y\,\overset{O}{\overset{\|}{P}}\,(OH)_{3-y}$$

where $x$ has the value of 1 to 15 and $y$ has the value of 1 to 3, derivatives of sulfo succinic acid, such as dihexylmethyl-amyl sulfo succinic acid, an alkyl sulfate, an alkyl aryl sulfonate, or an alkyl ethylene oxide ether sulfate, or mixtures thereof.

Generally, when utilizing a sequestering agent, it is well known to prevent corrosion of metals by the agent with a corrosion inhibitor. A variety of corrosion inhibitors useful in the drain cleaning compositions of this invention are available, as long as the corrosion inhibitor chosen adds no substantial amount of other alkali metal ions to the compositions. Most preferred are potassium silicate or potassium thioglycolate. The concentration of corrosion inhibitor may vary between zero and 10%, by weight, but from 0.25% to about 3.0%, by weight, of inhibitor is preferred.

Other ingredients, such as urea, are desirable in dissolving hair and other water-insoluble objects which form a clog.

In addition to the foregoing ingredients, the compositions of this invention may also include anti-soil redeposition agents, solubilizers, germicides, and other ingredients conventionally employed in drain cleaning compositions.

The drain cleaning compositions of this invention are prepared by mixing the ingredients, namely by dissolving the sequestering agent in water and adding potassium hydroxide until completely dissolved to form a drain cleaning composition having the desired composition. Generally, the order of mixing is not critical. However, when acidic surfactants or sequestering agents in the acid, form are used, it is better to dissolve the potassium hydroxide in the required amount of water before addition of the other ingredients.

In the following examples the drain cleaning compositions were applied to solid soap curd. The soap curd was a mixture of 80% calcium curd and 20% magnesium curd. The soap used to prepare the curds consisted of a mixture of 430.5 gm. of commercially available bar soaps, which were mixed and dissolved in 5 liters of hot water. The calcium and magnesium soap curds were prepared by precipitation from portions of the mixture by adding either calcium chloride or magnesium chloride. The precipitated soap curd was filtered, washed, and mixed at a ratio of 4 parts of calcium curd to one part of magnesium curd. The resulting mixture contained 33% soap curd and 67% water. For each test, 5.0 gm. of the mixed wet curd was pressed into the bottom corner of a beaker. One part of water for each one part of drain cleaning composition was also added so that the composition would be diluted and the test conditions would be similar to the conditions often present with clogged drains.

Effectiveness of the drain cleaning compositions of this invention was determined according to the amount of soap curd dissolved and time necessary to dissolve this amount of curd. All percentages in the Examples are given in terms of percent by weight. Also, the wetting agent used in each Example was one of the following

| | |
|---|---|
| Wetting Agent (1) | ammonium salt of a sulfated linear primary alcohol ethoxylate |
| Wetting Agent (2) | phosphate ester having the formula $[R-O(CH_2CH_2O)_x]_y P(=O)(OH)_{3-y}$, where x has a value of 1 to 15 and y has a value of 1 to 3. |

The specific wetting agents utilized in the following Examples are manufactured and supplied by General Aniline and Film Corporation, New York, New York, and respectively are identified by the names "Alipal-CD-128" and GAFAC-RA-600".

EXAMPLE 1

| | Percent |
|---|---|
| Tetra potassium ethylenediaminetetraacetic acid | .25 |
| Potassium hydroxide | 5.0 |
| Potassium thioglycolate | 10.0 |
| Wetting agent (2) | .25 |
| Water | 84.50 |

The soap curd cake was breaking apart in 1 hour and completely dissolved in 2 hours, thereby indicating that the solution would dissolve soap curd on contact and was an effective drain cleaning composition.

EXAMPLE 2

| | Percent |
|---|---|
| Tripotassium nitrilotriacetic acid | .25 |
| Potassium hydroxide | 5.0 |
| Potassium thioglycolate | .25 |
| Wetting agent (2) | .25 |
| Water | 84.50 |

The soap curd cake was breaking apart in 1 hour and completely dissolved in 2 hours, thereby indicating that the sequestering agent is not limited to ethylene-diamine tetraacetic acid and an effective drain cleaning composition is possible with other sequestering agents.

EXAMPLE 3

| | Percent |
|---|---|
| Tetra potassium ethylene-diamine tetraacetic acid | 1.0 |
| Potassium hydroxide | 2.0 |
| Water | 97.0 |

The soap curd cake was about 50% dissolved and breaking up in ½ hour. After 1 hour the soap curd cake was completely dissolved, thereby indicating that the solution was an effective drain cleaning composition.

EXAMPLE 4

| | Percent |
|---|---|
| Tetra potassium ethylene-diamine tetraacetic acid | 1.0 |
| Potassium hydroxide | .25 |
| Potassium thioglycolate | 1.0 |
| Wetting agent (2) | 1.0 |
| Water | 96.75 |

The surface of the solid soap curd cake was converted to a viscous gel and after 5 hours little or none of the soap curd dissolved, thereby indicating that potassium hydroxide was less than specified for the drain cleaning compositions of this invention.

EXAMPLE 5

| | Percent |
|---|---|
| Monoethanolamine ethylenediaminetetraacetic acid | 2.0 |
| Monoethanolamine thioglycolate | 2.0 |
| Wetting Agent (1) | .25 |
| Water | 95.75 |

The surface of the solid soap curd cake, was covered with a viscous gel within 10 minutes and little or no soap curd dissolved over 8 hours. This demonstrates that the addition of potassium hydroxide to the drain cleaning compositions is necessary.

EXAMPLE 6

| | Percent |
|---|---|
| Tetra-sodium ethylenediaminetetraacetic acid | 2.0 |
| Sodium hydroxide | 2.0 |
| Sodium thioglycolate | 1.0 |
| Wetting agent (2) | .25 |
| Water | 94.75 |

The surface of the solid soap curd contacted with the solution became covered with a layer of viscous gel within 10 minutes after contact. No solution of curd was visable after 48 hours, indicating that drain cleaning compositions of this invention require potassium and the presence of other alkali metal ions cause these compositions to be ineffective.

EXAMPLE 7

| | Percent |
|---|---|
| Tetra-potassium ethylenediaminetetraacetic acid | 2.0 |
| Potassium hydroxide | 2.0 |
| Sodium thioglycolate | 1.0 |
| Wetting agent (2) | .25 |
| Water | 94.75 |

The surface of the solid soap curd became coated with a film which prevented direct solution of the soap curd. Only after 16 hours was the curd dissolved, indicating that the composition was not effective because it was not substantially free of sodium ions.

EXAMPLE 8

| | Percent |
|---|---|
| Tetra-potassium ethylenediaminetetraacetic acid | 2.0 |
| Potassium hydroxide | 2.0 |
| Sodium thioglycolate | .5 |
| Wetting agent (2) | .25 |
| Water | 95.25 |

The soap curd dissolved slowly and was completely dissolved only after 8 hours, indicating the decreased effectiveness of the composition with less than 5% of the total ionic concentration being sodium ions.

EXAMPLE 9

| | Percent |
|---|---|
| Tetra-potassium ethylenediaminetetraacetic acid | 5.0 |
| Potassium hydroxide | 5.0 |
| Potassium silicate | 3.0 |
| Wetting agent (2) | .25 |
| Water | 86.75 |

The soap curd cake started to disintegrate within ½ hour and was completely dissolved in 1 hour, thereby indicating that the solution was an effective drain cleaning composition.

The following Examples further illustrate the drain cleaning compositions of the present invention.

EXAMPLE 10

| Ingredients | Percent |
|---|---|
| Tetra-potassium ethylenediaminetetra-acetic acid | .25 |
| Potassium hydroxide | .50 |
| Water | 99.25 |

EXAMPLE 11

| | |
|---|---|
| Tri-potassium nitrilotriacetic acid | 5.0 |
| Potassium hydroxide | .5 |
| Water | 94.5 |

EXAMPLE 12

| | |
|---|---|
| Potassium salt of N-2-hydroxyethyl-imino-diacetic acid | .25 |
| Potassium hydroxide | 10.0 |
| Water | 89.75 |

EXAMPLE 13

| | |
|---|---|
| Tri-potassium nitrilotriacetic acid | 10.0 |
| Potassium hydroxide | .5 |
| Water | 89.5 |

Inasmuch as the present invention is subject to many variations, modifications, and changes in detail, it is intended that all matter above described or shown in the examples be interpreted as illustrative and not in a limiting sense.

What is claimed is:

1. A drain cleaning composition consisting essentially of:

from about 0.25% to 10%, by weight, of a potassium salt of a member selected from the group consisting of nitrilotriacetic acid, N-2-hydroxyethylimino diacetic acid, an alkylene polyamine polycarboxylic acid, and mixtures thereof;

from about 0.50% to 10%, by weight, of potassium hydroxide; and up to about 99%, by weight, of water, wherein said composition is substantially free of other alkali metal ions.

2. A composition according to claim 1 wherein said alkylene polyamine polycarboxylic acid has the formula $$(HOOCCH_2)_2N[(CH_2)_xNCH_2COOH]_yCH_2COOH$$

wherein $x$ and $y$ may independently be from 1 to 7.

3. A composition according to claim 2 wherein said alkylene polyamine polycarboxylic acid has the formula $$(HOOCCH_2)_2N[(CH_2)_xNCH_2COOH]_yCH_2COOH$$

wherein $x$ and $y$ may independently be from 1 to 4.

4. A composition according to claim 2 wherein said potassium salt is present from about 0.25% to about 5.0%, by weight, and said potassium hydroxide is present from about 0.50% to about 5.0%, by weight.

5. A composition according to claim 3 wherein said potassium salt is present from about 0.25% to about 5.0%, by weight, and said potassium hydroxide is present from about 0.50% to about 5.0%, by weight.

6. A composition according to claim 5 wherein said member is selected from the group consisting of ethylenediaminetetraacetic acid, nitrilotriacetic acid, and N-2-hydroxyethylimino diacetic acid, and mixtures thereof.

7. A composition according to claim 6 wherein said potassium salt is present from about 1.0% to about 3.0%, by weight, and said potassium hydroxide is present from about 1.0% to about 3.0%, by weight.

8. A composition according to claim 7 wherein said composition additionally contains up to about 10%, by weight, of a corrosion inhibitor selected from the group consisting of potassium silicate and potassium thioglycolate.

9. A composition according to claim 8 wherein said composition additionally contains from about 0.25% to about 5.0%, by weight, of a potassium or ammonium salt of an anionic surfactant selected from the group consisting of:

lauryl sulfate;

a sulfated linear primary alcohol ethoxylate;

an anionic phosphate ester surfactant.

10. A composition according to claim 9 wherein said composition consists essentially of, by weight, about 5.0% of the potassium salt;

about 5.0% of potassium hydroxide;

about 3.0% of said corrosion inhibitor;

about 0.25% of said salt of said anionic surfactant; and the remaining portion is water.

* * * * *